United States Patent [19]

Jones

[11] Patent Number: 4,950,012

[45] Date of Patent: Aug. 21, 1990

[54] UNIVERSAL ACCESSORIES REMOVER FOR LOCOMOTIVES

[76] Inventor: Harmon L. Jones, 7737 Kittrell La., Ooltewah, Tenn. 37363

[21] Appl. No.: 367,794

[22] Filed: Jun. 19, 1989

[51] Int. Cl.[5] ..... B66C 1/22

[52] U.S. Cl. ..... 294/67.2; 294/67.5

[58] Field of Search ..... 294/67.1–67.22, 294/67.5, 81.3, 81.4, 82.1, 92.11, 92.12, 92.14, 86.41

[56] References Cited

U.S. PATENT DOCUMENTS

| | | | |
|---|---|---|---|
| 1,195,518 | 8/1916 | Simpson et al. | 294/67.2 |
| 1,783,021 | 11/1930 | Leach | 294/67.2 X |
| 1,804,266 | 5/1931 | Moore | 294/67.2 |
| 2,063,040 | 12/1936 | Jolly | 294/82.12 |
| 2,329,008 | 9/1943 | Smith | 294/67.5 |
| 2,349,717 | 5/1944 | Graham | 294/67.5 |
| 2,600,538 | 6/1952 | Jackes et al. | 294/67.2 |
| 3,696,487 | 10/1972 | Mrugala et al. | 294/67.22 |
| 3,843,185 | 10/1974 | James et al. | 294/67.1 X |
| 4,431,223 | 2/1984 | Miller | 294/67.5 X |
| 4,773,688 | 9/1988 | Jones | 294/67.22 |

FOREIGN PATENT DOCUMENTS

| | | | |
|---|---|---|---|
| 137432 | 9/1979 | German Democratic Rep. | 294/67.1 |
| 127187 | 1/1960 | U.S.S.R. | 294/67.22 |
| 878726 | 11/1981 | U.S.S.R. | 294/67.2 |
| 1017647 | 5/1983 | U.S.S.R. | 294/67.21 |
| 1199735 | 12/1985 | U.S.S.R. | 294/67.2 |
| 2156312 | 10/1985 | United Kingdom | 294/67.22 |

*Primary Examiner*—Johnny D. Cherry

[57] ABSTRACT

This invention is a single suspending device for replacing different types of locomotive engine accessories in a generally easy manner, without the need to adjust the arm(s) of the device, or to forcibly adjust an accessory relative to the arm(s) of the device, during the process of replacing an accessory. Its construction includes a rigid hoisting frame having an outer arm rigidly attached to an upper arm, to which is attached a counterweight and a suspending clevis, the clevis being located central to the center of balance of the accessory being removed. The outer arm has at its lower portion dual points of attachment for a removable lower arm, these points of attachment being for the purpose of changing the clearance between the upper arm and the lower arm, thus increasing the range of applications for the device. The lower arm is an inward reaching boom having an outer portion with an attachment for the rigid frame's outer arm, an elevated inner portion with an attachment for a hoisting sling, and a center portion that rigidly connects the outer portion and elevated inner portion together. The hoisting sling has at its lower extermity an attachment for the accessory being removed, and along its length are several lifting lugs which attach to the elevated inner portion of the lower arm, the spacing of these lugs being for the purpose of allowing for different lengths of hoisting cable to be extended from its attachment point on the lower arm to the particular part being removed.

4 Claims, 2 Drawing Sheets

FIG. 1
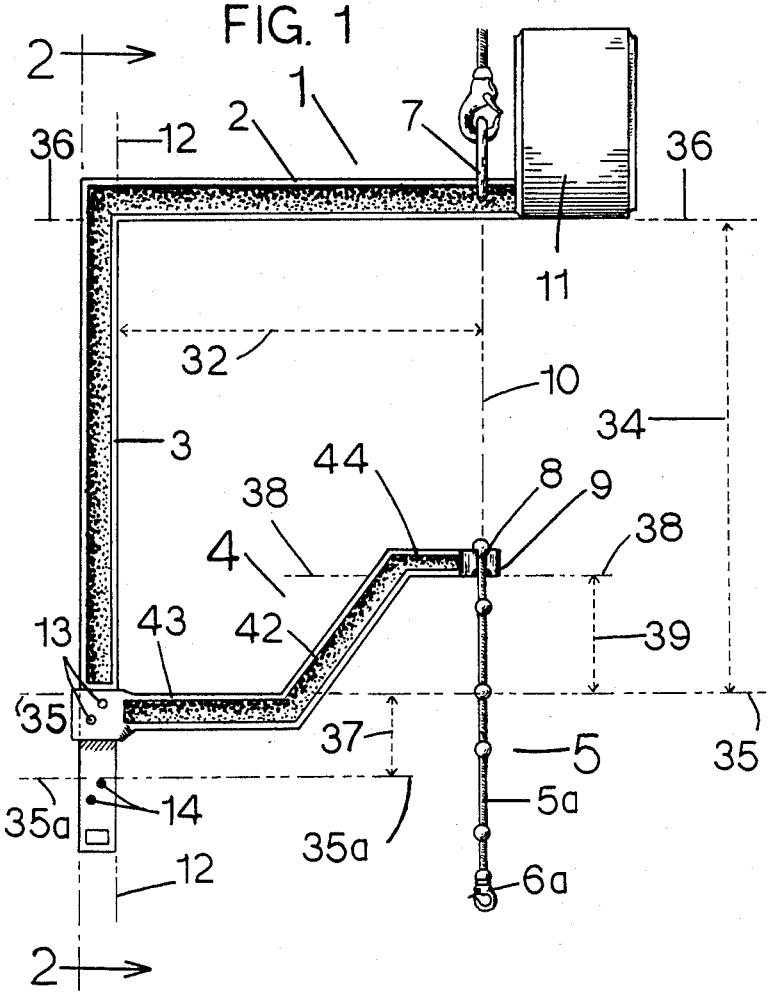
FIG. 2
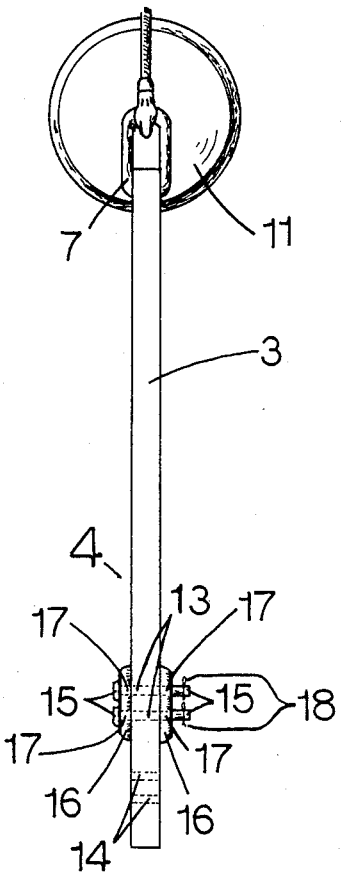
FIG. 3
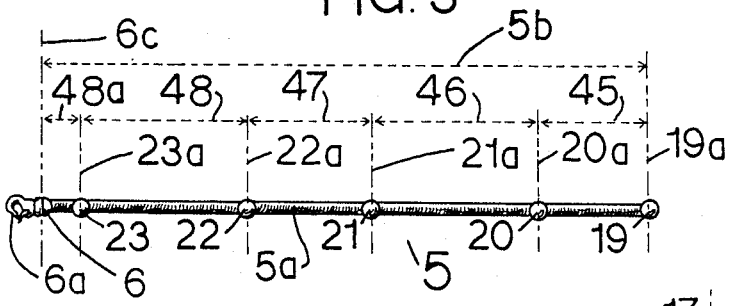
FIG. 4
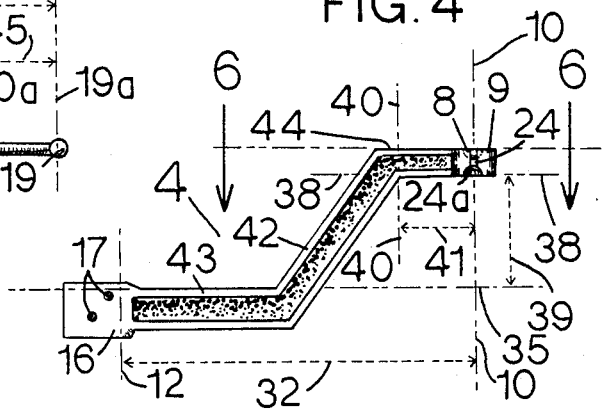
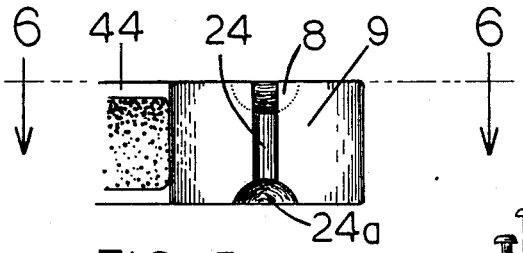
FIG. 5
FIG. 6
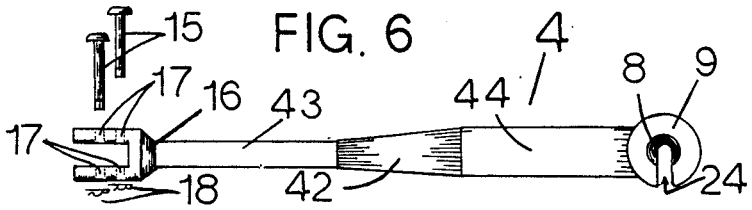

ACCESS DOORS

UNIVERSAL ACCESSORIES REMOVER FOR LOCOMOTIVES

BACKGROUND OF THE INVENTION

In locomotive repair shops, the only means of safely replacing the engine accessories of General Motors locomotives is twofold. The first method is by means of a tramrail that is inserted through the openings of the carbody access doors, suspended from the carbody, and used in conjunction with come-alongs to hoist the accessories and transfer them laterally to the side of the locomotive, where they are lowered onto transport wagons. The other means of removal is by removing the locomotive carbody hatch. An undesirable third method, and one in common use on some rail lines, is removal by hand. Since these accessories weigh from 65 to 275 lbs., it is clear that this means of removal is unsafe.

The most practical means of removal, with the tramrail and come-along, is sometimes very difficult to endeaver, because often the tramrail can not be secured to the locomotive carbody without first welding an attachment bracket to the carbody. Then, once the tramrail is in place, the area left to the mechanic to work in is reduced, and as a result he is put in a bind when removing the accessories and operating his come-along. Also, once the tramrail is secured in place over the accessories, it has only lateral flexibility, and all forward-reverse movement of the accessories necessary for removing them from their engine flanges must be made forcibly and away from the center of gravity of the tramrail. Further, the mechanical come-along is slow in its function of raising and lowering accessories, and at the same time requires an undue amount of arm action, with the ratchet arm of the come-along usually being restricted or interfered with by other parts in the small confines of what is known in rail shops as the accessories room; i.e. the area at the front of the engine where the engine small parts are located. Because of the closeness of these rooms, electric and hydraulic lifts suspended from the tramrail are unacceptable due to the danger that error of operation may trap or injure the mechanic. Also, the danger of a hydraulic or electric line being cut is apparent.

Two existing inventions address the special needs for removing certain larger locomotive parts, but fail to be of assistance in the removal of the smaller engine accessories.

The first example is that of James, with his Power Assembly Removal Tool, U.S. Pat. No. 3,843,85. This is a hydraulics actuated lifting device designed for removing power assemblies from locomotives without removing the carbody hatch. Although this device satisfies the need for assembly removal, it can not be used as a universal engine accessories remover because of its design and because it has no means of attachment to engine accessories. Further, it can not be modified to attach to engine accessories without rendering it useless for pulling power assemblies.

The second example is that of Jones, with his Oil Cooler Puller Having Only One Suspension Point, U.S. Pat. No. 4,773,688. Again, the inventor addresses the needs of removing a particular large part on the locomotive, in this case an oil cooler; and again, the device satsifies its claims, but can not be used as a universal engine accessories remover because it has no means of attachment to engine small parts, nor could it be modified to be a universal accessories remover without rendering it useless for pulling oil coolers.

In both of the above cases, it can be seen that to attempt modification of the lower arms to the use of universal engine accessories removers would render the inventions useless in their intent and violate the letter of their claims.

SUMMARY OF THE INVENTION

A universal accessories remover for locomotives is a balanced fixture "comprised of a rigid frame, a removable lower arm, and a hoisting sling". The rigid frame has a suspension point on its upper arm that is central to the load(s) being lifted, to which an overhead crane or other suspendor can be attached and from which the fixture is hoisted in a balanced manner, with or without its load attached. The outer arm of the rigid frame is equipped with two pairs of dowel holes at its lower end whose purpose is to allow for a dual option of the placement of the lower arm relative to its distance from the upper arm, without effecting the center of balance of the fixture. The purpose of this option is to allow for increased carbody hatch dimensions over the air compressor. The lower arm of the fixture is of such design that it can be used on all intended applications without fouling other parts of the locomotive, and has on its inner end a lifting boss that accommodates a removable and lugged lifting cable. The lifting cable has five lifting lugs, each of which fits into the lifting boss of the lower arm; and a swivel hook on its end that is secured to the accessory being lifted. The five lifting lugs allow the remover to be used on various accessory applications depending upon their distance below the lifting boss of the lower arm when the fixture is at the lowest practical point that the locomotive carbody hatch will allow.

It can be seen that the invention is an improvement over conventional means of engine accessories removal in that it allows the mechanic more flexibility when removing accessories, and allows for the removal of the accessories without removing the carbody hatch, thus being safer than the accepted practices, and less time consuming.

BRIEF DESCRIPTION OF THE DRAWINGS

FIG. 1 is a front elevational view of a universal accessories remover for locomotives, suspended from the hook of a crane or other lifting device; drawn on a scale of approximately 20:1 and showing necessary dimensions.

FIG. 2 is a vertical sectional view of the frame assembly shown in FIG. 1, but without its lugged lifting cable, as taken from line 2—2; drawn on a scale of approximately 20:1.

FIG. 3 is a horizontal view of the lugged lifting cable; done on a scale of approximately 10:1 and showing necessary dimensions.

FIG. 4 is a front elevational view of the lower arm of the frame assembly; drawn on a scale of approximately 20:1 and showing necessary dimensions.

FIG. 5 is a sectional view of the lower arm shown in FIG. 4, showing the details of the lifting boss.

FIG. 6 is a top perspective view of the lower arm, as taken from line 6—6 in FIG. 4.

DESCRIPTION OF THE PREFERRED EMBODIMENT

Figure 8:
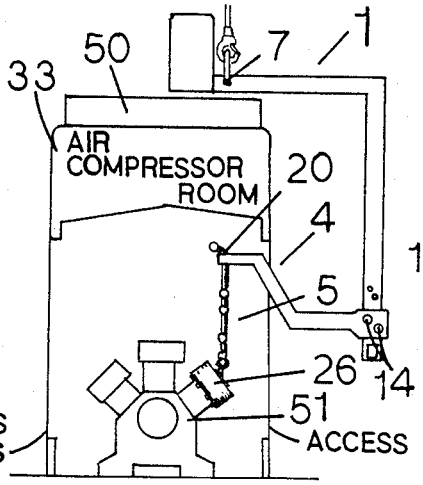
FIGS. 8 and 9 are front elevational views showing the universal accessories remover attached to an air compressor's low pressure head.
Figure 9:
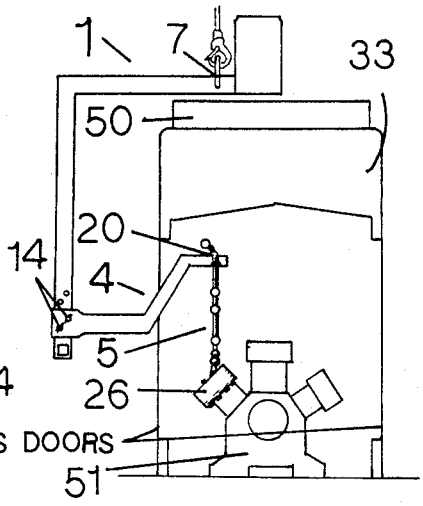
Figure 11:
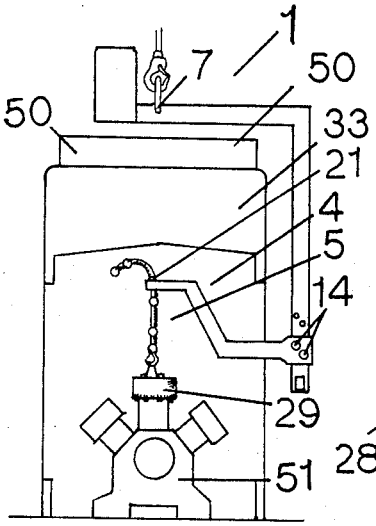
FIG. 11 is a front elevational view showing the universal accessories remover attached to an air compressor's high pressure head.

Referring to FIGS. 1 and 2 of the drawings, a universal accessories remover 1 for locomotives has an upper arm 2, an outer arm 3, a removable lower arm 4 and a removable lugged lifting cable 5 with a swivel lifting hook 6a at its lower end. The upper arm 2 has a hoisting clevis 7 that is located at a point central to the lug pocket 8 of the lifting boss 9 and the center of balance 10 of both the remover and the load being lifted, and has at its inner extremity a counterweight 11 that balances the remover 1 relative to the center of balance 10. The outer arm 3 has at its lower end two (2) sets of dowel holes 13 and 14 which are machined to accept the dowel pins 15 of the lower arm 4, and which allows for two separate positions of the lower arm 4, with the lower position taken from lower dowel holes 14, such position being necessary only to remove air compressor components 26 and 29, because of increased carbody hatch 33 dimensions resulting from engine cooling fans 50 located above the air compressor 51, as seen in FIGS. 8, 9, and 11 of the drawings.

Figure 7:
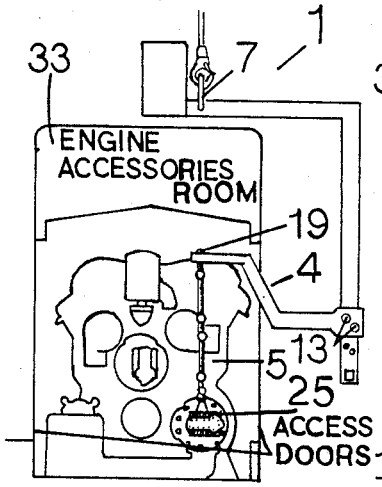
FIG. 7 is a front elevational view showing the universal accessories remover attached to an engine oil scavenge pump.
Figure 10:
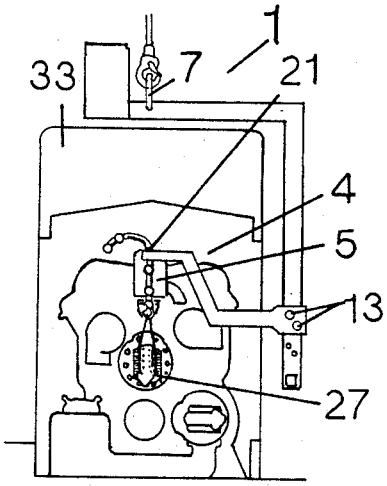
FIG. 10 is a front elevational view showing the universal accessories remover attached to an engine oil pressure pump.

Referring to FIGS. 2, 4 and 6 of the drawings, the lower arm 4 has at its outer portion 43 a doweled yoke 16 which has two (2) dowel holes 17 drilled through both necks of the yoke 16, which are mated to both pairs of dowel holes 13 and 14 of the outer arm 3, and through which the dowel pins 15 are inserted when aligned with the dowel holes 13 or 14 of the outer arm. The dowel pins 15 are equipped with securing pins 18, of such type that will satisfactorily prevent the dowel pins 15 from accidentally working loose from their fully inserted positions in the dowel yoke 16. As shown in FIGS. 4, 5 and 6, the elevated inner portion 44 of the lower arm 4 has a lifting boss 9 which is equipped with a lifting lug pocket 8, a cable access slot 24, and a safety hook lug access well 24a, and which is designed to accommodate the lifting cable 5. As shown in FIG. 3, the lifting cable 5 is provided with five (5) lifting lugs, 19–23, with uppermost lifting lug 19 being designed to hoist engine oil scavenge pumps 25 as shown in FIG. 7 of the drawings. Lifting lug 20 is used to hoist air compressor low-pressure heads 26 as shown in FIGS. 8 and 9 of the drawings. Lifting lug 21 is used to hoist engine oil pressure pumps 27 as shown in FIG. 10 of the drawings and air compressor high pressure heads 29 as shown in FIG. 11 of the drawings.

Figure 12:
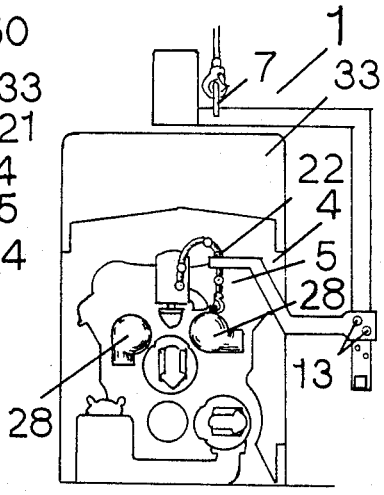
FIG. 12 is a front elevational view showing the universal accessories remover attached to an engine water pump.
Figure 13:
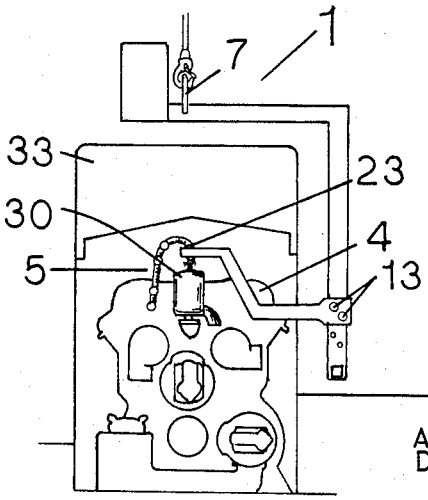
FIG. 13 is a front elevational view showing the universal accessories remover attached to an engine governor.
Figure 14:
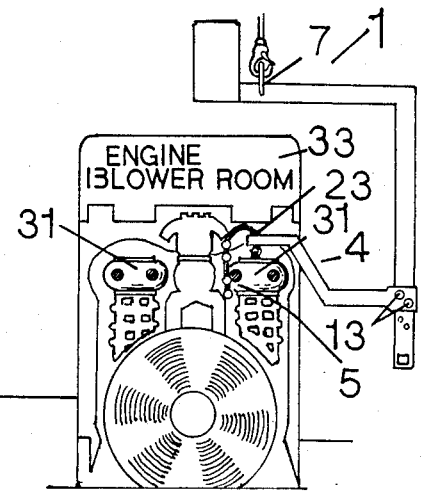
FIG. 14 is a front elevational view showing the universal accessories remover attached to an engine blower.

Lifting lug 22 is used to hoist engine water pumps 28 as shown in FIG. 12 of the drawings. Lifting lug 23 is used for hoisting engine governors 30 as shown in FIG. 13 of the drawings, and most engine blowers 31 (switcher units exempted) as shown in FIG. 14 of the drawings. The lower end of the lifting cable 5 is provided with a swivel hook 6a which should be of a safety hook design.

Referring to the dimensions of the remover 1 as shown in FIG. 1 of the drawings, dimension 32 is to be forty-eight (48) inches, and is the distance from the inside plane 12 of the outer arm 3 to the center of balance 10, and is necessary to insure that the remover 1 can reach all engine accessories and air compressor components without fouling the locomotive carbody hatch 33 as shown in FIGS. 7–14 of the drawings. Dimension 34 is to be sixty-two (62) inches, and is the distance from the upper plane 35 of the outer portion 43 of the lower arm 4 when the lower arm 4 is in the uppermost position (from dowel holes 13) of the outer arm 3 to the lower plane 36 of the upper arm 2, and is also a necessary element of the design to insure that the remover 1 will not foul the locomotive carbody hatch 33 as shown in FIGS. 7–14 of the drawings when the engine accessories are being removed. Dimension 37 is ten (10) inches, and represents the difference from the upper plane 35 of the outer portion exterior 43 of the lower arm 4 when the lower arm 4 is secured in the lower position on plane 35a (dowel holes 14) of the outer arm 3, as opposed to its upper position on plane 35 (dowel holes 13).

Referring to the dimensions of the lower arm 4 as shown in FIG. 4 of the drawings, dimension 39 is sixteen (16) inches, and represents the distance from the upper plane 35 of the outer portion 43 of the lower arm 4 to the lower plane 38 of the elevated inner portion 44 of the lower arm 4. Dimension 41 is twelve and one-half (12½) inches, and represents the length of the lower plane 38 of the elevated inner portion 44 from the point 40 where the 44 intersects with the connecting portion 42 to the cable access slot 24. Dimensions 39 and 41 are necessary elements of configuration of the lower arm 4 to allow for removal of engine governors 30 and engine blowers 31, as shown in FIGS. 13 and 14 of the drawings. Dimension 32 is 48 inches, and is the same dimension as shown in FIG. 1 of the drawings; and represents the distance from the center of balance 10 to the inside plane 12 of the outer arm 3 when the lower arm 4 is attached to the frame 1, and is a necessary element the removal of engine governors 30, engine oil pressure pumps 27 and high pressure heads 29 of the air compressor 51, as shown in FIGS. 10, 11, and 13 of the drawings.

Referring to the dimensions of the lugged lifting cable 5 as shown in FIG. 3, the total length 5b of the cable portion 5a is approximately forty (40) inches, and is the approximate sum of dimensions 45, 46, 47, 48 and 48a. Dimension 45 is seven (7) inches, and represents the distance from the center 19a of lifting lug 19 to the center 20a of lifting lug 20. Dimension 46 is eleven (11) inches, and represents the distance from the center 20a of lifting lug 20 to the center 21a of lifting lug 21. Dimension 47 is eight (8) inches, and represents the distance from the center 21a of lifting lug 21 to the center 22a of lifting lug 22. Dimension 48 is eleven (11) inches, and represents the distance from the center 22a of lifting lug 22 to the center 23a of lifting lug 23. Dimension 48a is three (3) inches, and represents the distance from the center 23a of lifting lug 23 to the center 6c of the lug 6 of the swivel hook 6a.

What is claimed is:

1. A device for replacing diverse engine accessories of a locomotive precluding the need, during the process of replacing any said accessory, to make mechanical or physical adjustments of the frame or arms of said device, or to make a forced adjustment, relative to the frame or arms of said device, of the accessory being replaced comprising: a hoisting frame having a horizontally extending upper arm rigidly attached to a vertically extending outer arm, said outer arm having at its lower portion means of attachment for a lower arm; and a lower arm having a configuration that renders it capable of reaching diverse engine accessories located in interior areas of locomotive carbodies, such configuration being composed of an outer portion, an elevated inner portion, and a connecting portion that rigidly attaches said outer portion to the elevated inner portion, said outer portion having at its outer end means of attachment to the outer arm of the hoisting frame, and the elevated inner portion having at its inner end means of attachment to a hoisting sling; and a hoisting sling having several means of attachment to said elevated inner portion of the lower arm, said several means of attachment being positioned at several points along the length of the hoisting sling, said sling having at its lower end means of attachment to the accessory being hoisted.

2. A device as in claim 1 further including dual means of attachment for the lower arm, such dual means being located at the lower end of the outer arm of the hoisting frame for changing the distance between said lower arm and said upper arm.

3. A device as in claim 1 further including means attached to the upper arm of the hoisting frame, said attached means being located at such point on the upper arm that is central to a suspended load for suspending said device.

4. A device as in claim 1 further including means affixed to the inner end of said upper arm, which balances said device when it is hoisted from a suspending means.

* * * * *